US007147190B2

(12) United States Patent
Welles et al.

(10) Patent No.: US 7,147,190 B2
(45) Date of Patent: Dec. 12, 2006

(54) MULTIPOSITIONAL ACCESSORY SHELF FOR A COMPUTER MOUSE OR OTHER ACCESSORY ITEMS

(75) Inventors: Toby S. Welles, Redding, CT (US); George Mileos, Riverdale, NY (US)

(73) Assignee: Humanscale Corporation, New York, NY (US)

( * ) Notice: Subject to any disclaimer, the term of this patent is extended or adjusted under 35 U.S.C. 154(b) by 191 days.

(21) Appl. No.: 10/737,041

(22) Filed: Dec. 15, 2003

(65) Prior Publication Data

US 2004/0227042 A1 Nov. 18, 2004

Related U.S. Application Data

(60) Provisional application No. 60/298,575, filed on Jun. 16, 2001, provisional application No. 60/299,080, filed on Jun. 18, 2001.

(51) Int. Cl.
*A47B 96/06* (2006.01)

(52) U.S. Cl. ..... 248/229.16; 248/918

(58) Field of Classification Search ..... 248/229.1, 248/229.15, 229.16, 229.25, 229.26, 918, 248/201, 200

See application file for complete search history.

(56) References Cited

U.S. PATENT DOCUMENTS 2,599,303 A * 6/1952 Ward ..... 248/229.26
6,481,681 B1 * 11/2002 Stunkel et al. ..... 248/231.31
6,685,151 B1 * 2/2004 Vasquez et al. ..... 248/227.1

* cited by examiner

*Primary Examiner*—Ramon O Ramierz
(74) *Attorney, Agent, or Firm*—Alston & Bird LLP

(57) ABSTRACT

The present invention is directed to multipositional accessory shelf support mechanism for placing items (e.g., hand-held items such as a computer mouse) on a shelfing surface so that such items are readily accessible while a user is operating his or her computer. Specifically, the present invention comprises a first and second bracket means connected to each other by at least one pair of linkage arms. The first bracket means is attached to a work surface, preferably a keyboard support tray. The second bracket means is capable of supporting an accessory shelf. In one alternative embodiment, the first and second bracket means are pivotally connected to each other. This linkage enables the accessory shelf positioned thereon to be vertically maneuvered upwardly or downwardly. The first bracket means may be removably attached to the work surface. This enables the support assembly to be removed from one area of the work surface and then attached to another area. In another alternative embodiment, the accessory shelf is pivotally attached to the second bracket means so that the mouse shelf can be swiveled over the work surface or any other desired position. Also, the present invention may comprise a means for tilting the accessory shelf in a desired position. In another alternative embodiment, the first bracket means is slidably attached to the work surface. This enables the accessory shelf to be slidably moved along the work surface or portion thereof.

51 Claims, 15 Drawing Sheets

MULTIPOSITIONAL ACCESSORY SHELF FOR A COMPUTER MOUSE OR OTHER ACCESSORY ITEMS

1. CROSS REFERENCES TO RELATED APPLICATIONS

This application claims priority under 35 U.S.C. § 119(e) from U.S. Provisional Applications Ser. Nos. 60/298,575 and 60/299,080, filed Jun. 16, 2001 and Jun. 18, 2001, respectively. Each of these prior applications is incorporated herein by reference in its entirety.

2. FIELD OF THE INVENTION

The present invention relates to multipositional accessory shelf support mechanism and, more particularly, to an improved support arrangement for a computer system which employs an accessory shelf that is multipositional relative to a work surface (e.g., a keyboard support tray) for improved convenience and accessibility to accessory items including, but not limited to, a computer mouse.

3. BACKGROUND OF THE INVENTION

Use of a computer mouse, as well as other computer accessory items, e.g., palm pilot, miniature video camera, cellular telephone, etc., requires constant hand and arm movement when using these items while operating a computer keyboard. Constant and continual movement of the user's hand to move the mouse or to access other accessory items can be tiring and stressful to the user. In response to these problems, a number of devices have been devised to mitigate the constant hand and arm movement while operating a computer. However, with many of these devices, control of the mouse or access to other accessory items while operating the computer is often compromised.

It is therefore an object of the present invention to provide an accessory shelf support mechanism that enables the user to easily attach an accessory shelf to either the left or right side of a work surface, such as a keyboard support tray.

It is also an object of the present invention to provide an accessory shelf support mechanism for an accessory item that provides comfort during continued use, but without lessened control or access to the item.

It is also an object of the present invention to provide an accessory shelf support mechanism that permits an accessory item to be positioned alongside and/or above the work surface when the entire work surface must be accessible. In this position, the accessory item can be at least substantially at the same level as the work surface, thus facilitating the ease with which the user can move his or her hands from the work surface to the accessory item and vice versa.

It is also an object of the present invention to provide an accessory shelf support mechanism that permits the shelf to be swiveled into a position above the work surface. This type of positioning may provide a shortened distance between the work surface and the accessory item, thus rendering the item more accessible to the user.

These and other objects, features and advantages of the present invention will become apparent to persons familiar with structures of this general type from the following discussion and drawings.

DESCRIPTION OF THE INVENTION

Figure 1:
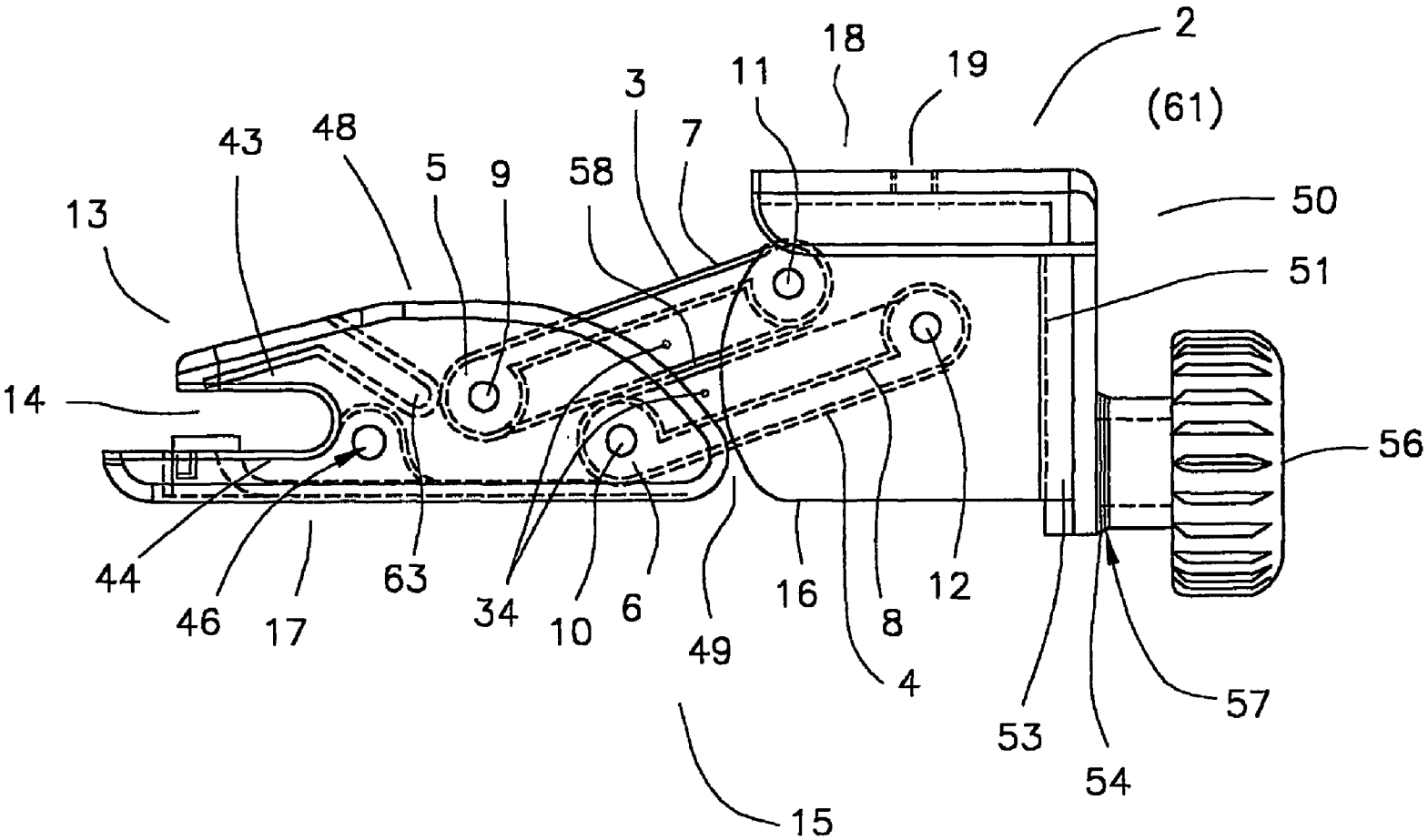
FIG. 1 is a side view showing an alternative embodiment of the accessory shelf support mechanism of the present invention.
Figure 2:
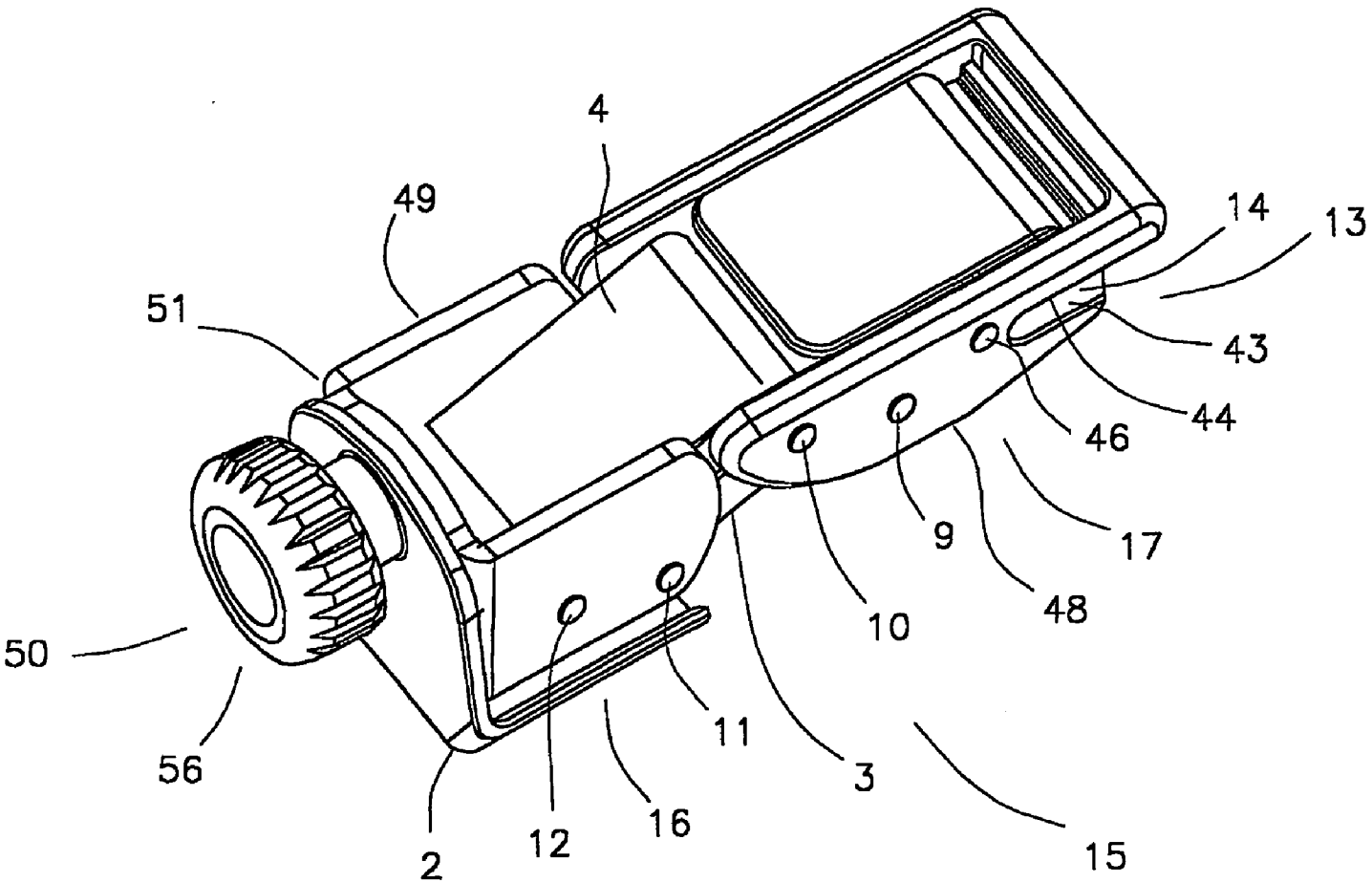
FIG. 2 is the embodiment of FIG. 1 showing the bottom thereof.
Figure 3:
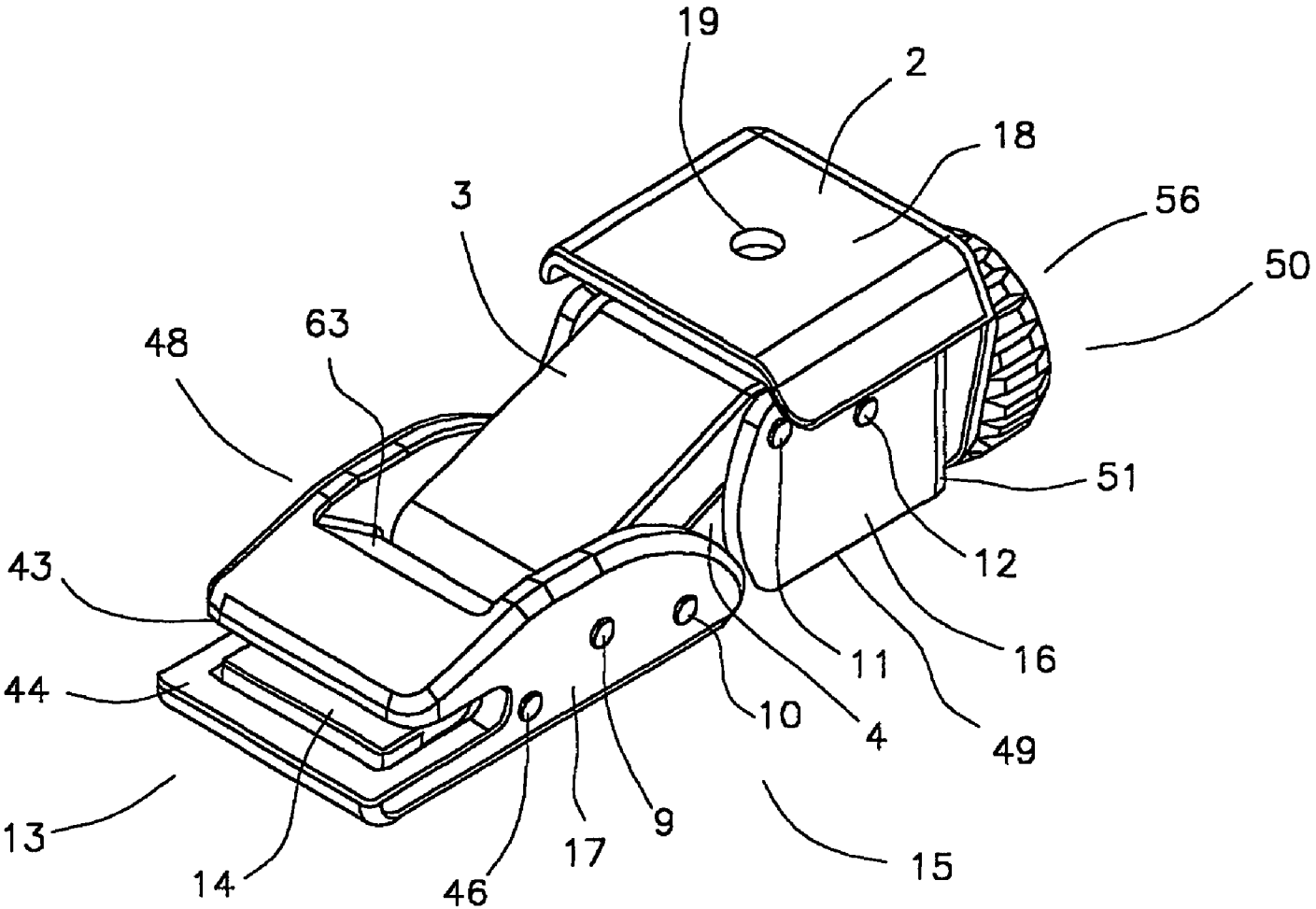
FIG. 3 is a perspective view of the embodiment of FIG. 1.
Figure 4:
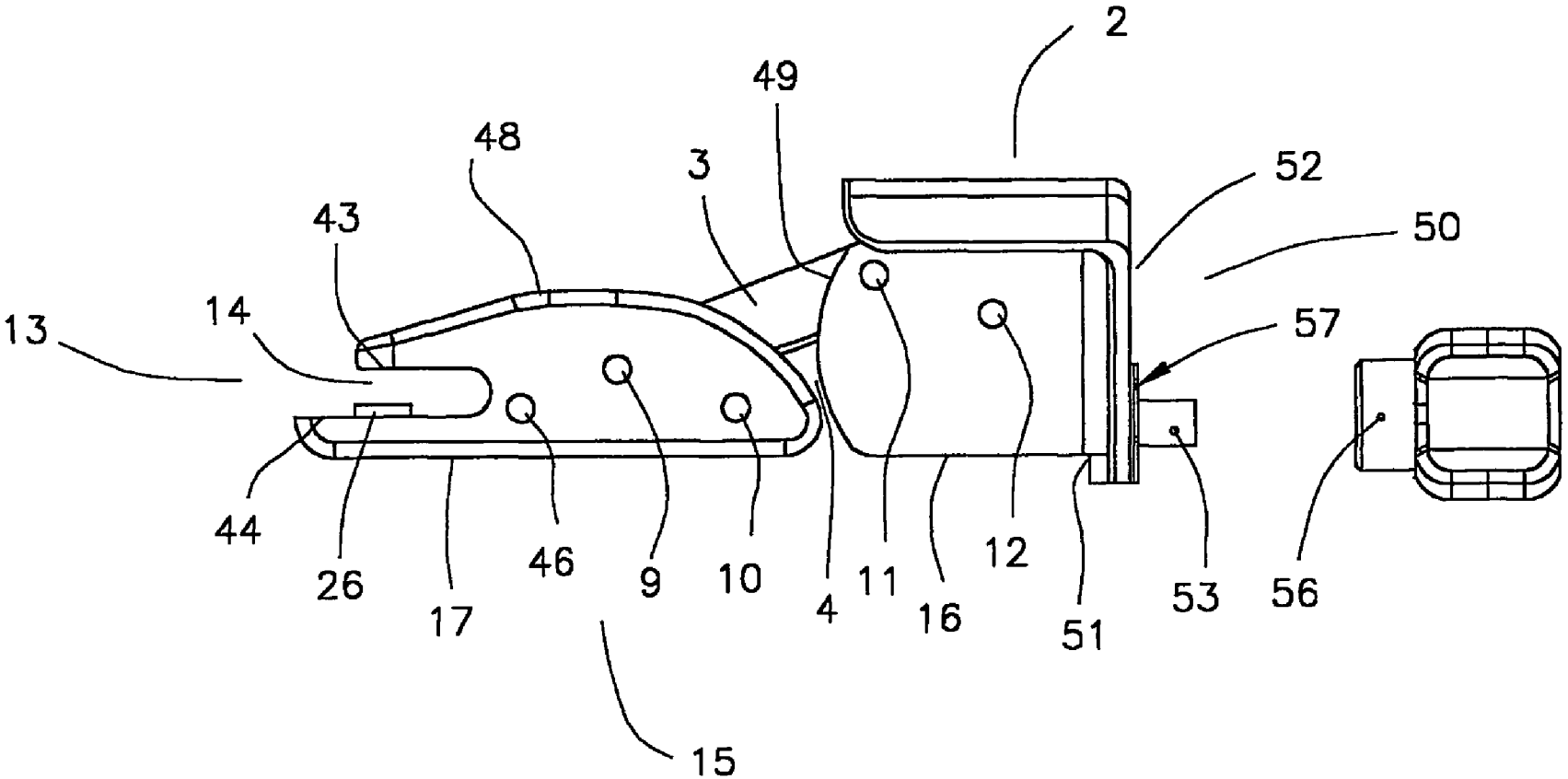
FIG. 4 is the embodiment of FIG. 1 showing internal components of the tilt mechanism.
Figures 5A, 5B:
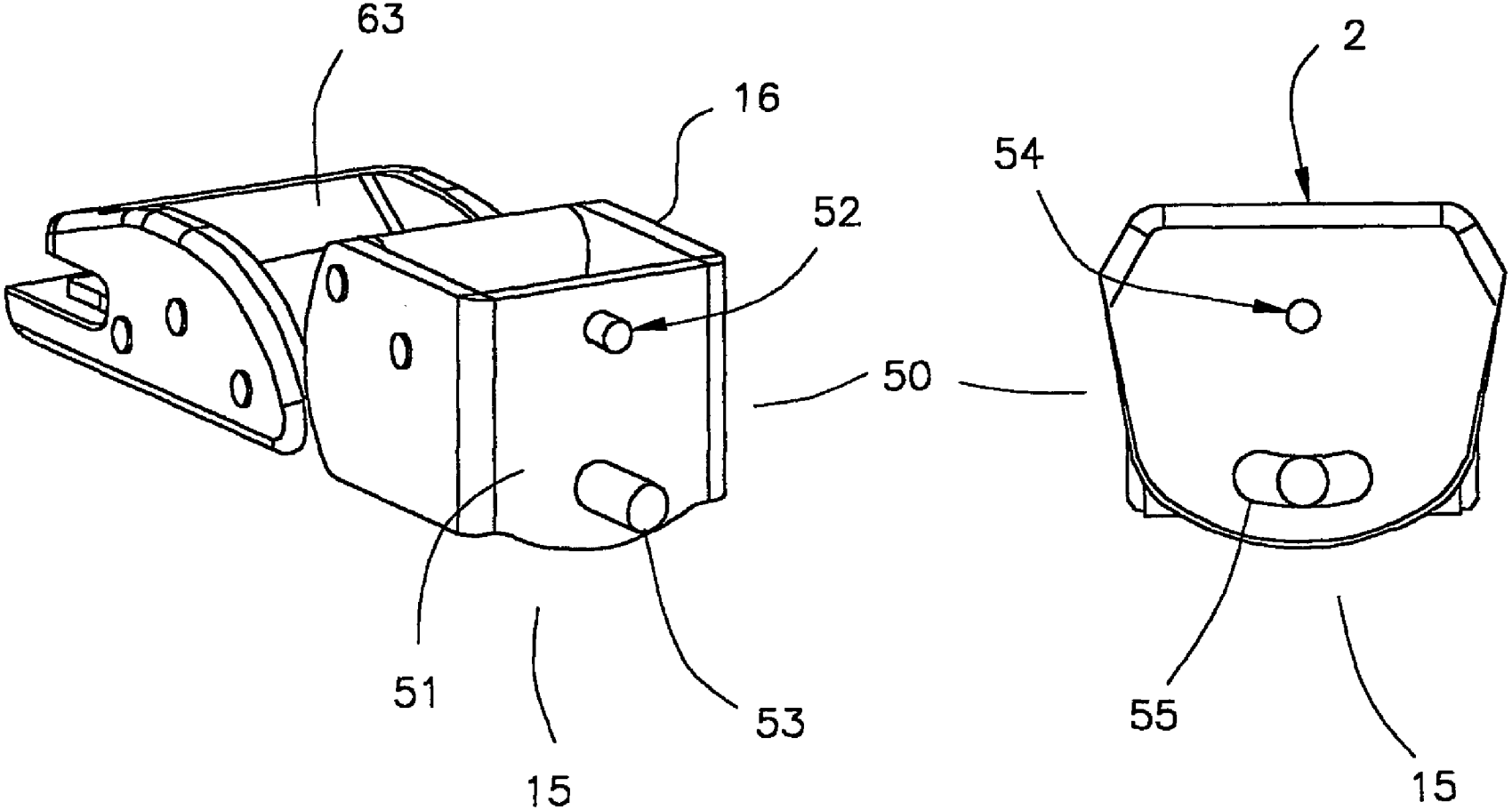
FIGS. 5*a* and 5*b* are the embodiment of FIG. 1 with the shelf bracket detached therefrom.

The present invention is directed to an accessory shelf for conveniently placing items thereon while the user is operating his or her computer. As used herein, the term "accessory shelf" includes, but is not limited to, include a surface on which the accessory item may be placed. In one alternative embodiment, the accessory shelf may also serve as the surface on which the accessory item is directly placed on. The accessory items include, but are not limited to, a computer mouse, mouse pad, palm pilot, miniature video camera, or other computer accessory items. In one alternative embodiment, the present invention is suitable for attachment to a keyboard support tray.

The multipositional accessory shelf support mechanism of the present invention comprises a first and second bracket means connected to each other by at least one linkage arm, preferably a pair of linkage arms. In the present invention, the first bracket means comprises an attaching means for attaching to a work surface. As used herein, the term "work surface" includes any suitable work surface for the present invention, including but not limited to a desk, table, shelf, or preferably a keyboard support tray. The first bracket means may be removably attached to the work surface. In one alternative embodiment, the accessory shelf support mechanism may be removed from one side of the work surface and then attached to the other side, or any other location of the work surface.

Accessory Shelf Support Mechanism

Referring to the figures herein, there is illustrated non-limiting alternative embodiments of a multipositional accessory shelf support mechanism (15) according to the present invention. These embodiments may comprise one or more similar components, in which case, these components are identified by like numbers in the Figures.

The multipositional accessory shelf support mechanism of the present invention comprises a first bracket means (17) and a second bracket means (16). The first bracket means (17) comprises an attaching means (13) for securely positioning the first bracket means support mechanism (17) to an area of a work surface. The second bracket means (16) is adapted to support an accessory shelf (1).

Second Bracket Means

The configuration of the second bracket means (16) may vary depending on the specific use to be made of the present invention. In one alternative embodiment, the second bracket means (16) may comprise at least one side wall. It may also comprise a front or rear wall. The second bracket means may also comprise a top surface or bottom surface. The second bracket means may be attached to an accessory shelf or shelf bracket.

Accessory Shelf

The present invention is not limited to any particular design of the accessory shelf, as such design may vary depending on the user's habits or requirements, for example. In one alternative embodiment, the accessory shelf may be sized to receive, for example, a mouse pad, or provide a suitable surface for receiving a mouse thereon. It may also be sized for receiving other computer accessory items, for example.

In one embodiment, the accessory shelf is connected to the second bracket means. The means by which the accessory shelf is connected to the second bracket means may comprise many forms, including, but not limited to, any suitable means utilizing one or more bolts, clamps, hooks, latches, locks, pins, rivets, screws or any combination thereof. In another alternative embodiment, the accessory shelf may be fastened to the second bracket means by spot welding, flat riveting or any other conventional means. In another alternative embodiment, the second bracket means and the accessory shelf may be cast as a continuous unit.

Accessory Shelf Bracket

The configuration of the accessory shelf bracket can vary depending on the specific use to be made of the present invention. For example, the accessory shelf bracket may be sized so as to enable it to support thereon an accessory shelf. In one alternative embodiment, the shelf bracket (2) may comprise a surface on which an accessory shelf can be securely placed. Said surface may take the form of a platform (18). The platform (18) may have an aperture (19) for receiving a pin protruding underneath the accessory shelf. Alternatively, the platform (18) may have a pin for insertion into a hole underneath the accessory shelf.

In one embodiment, the accessory shelf bracket (2) is connected to the second bracket means (16). The means by which the accessory shelf bracket is connected to the second bracket means may comprise many forms, including, but not limited to, any suitable means utilizing one or more bolts, clamps, hooks, latches, locks, pins, rivets, screws or any combination thereof. In another alternative embodiment, the accessory shelf bracket may be fastened to the second bracket means by spot-welding, flat riveting or any other conventional means. In another alternative embodiment, the second bracket means and the shelf bracket may be cast as a continuous unit. In yet another alternative embodiment, the second bracket means is connected to the shelf bracket, which in turn is connected to the accessory shelf. In this embodiment, these components may be cast as a continuous unit.

First and Second Bracket Means

The first bracket means (17) and second bracket means (16) are connected to each other by at least one linkage arm, or any equivalent thereof. In one alternative embodiment, the first and second bracket means (16, 17) are connected to each other by first and second linkage arms (3, 4). First and second linkage arms (3, 4) each having a front end (5, 6) and a rear end (7, 8, respectively). The front end (5, 6) of both linkage arms being connected to the first bracket means (17). The rear end of each linkage arm (7, 8) being attached to the second bracket means (16). The linkage arms may be stationarily connected to the appropriate bracket means. Alternatively, the linkage arms may be pivotally connected to the first and second bracket means. Also, the distance between the first and second linkage arms may be equal to provide a parallel linkage, or the distance can be unequal to provide a non-parallel linkage. In one alternative embodiment, the first and second bracket means (16, 17) are interconnected by a pair of at least substantially parallel linkage elements (3, 4) forming a parallelogram linkage. Specifically, linkage arms (3, 4) are pivotally fixed at one end to the second bracket means (16) at spaced locations. Each linkage arm is also pivotally fixed at the other end to the first bracket means (17) at spaced locations, thus permitting movement of the second bracket means while the first bracket means is mounted to an area of the work surface. Throughout such movement the attitude of the mouse pad support remains substantially constant.

The opposite end of each linkage arm (3, 4) may be stationarily fixed or pivotally connected to the appropriate brackets by any conventional means. For example, the ends of the linkage arms may be pivotally connected to the appropriate brackets by means of one or more rods. In an alternative embodiment, the rods may be friction fitted through a proper sized aperature in the bracket means, and fitted through the linkage arms so as to permit movement thereof. In another embodiment, a rod may be capped at one end and fit into a first or second pivot points (9, 10) of the first bracket means (17). A second rod may be capped at one end and fit into a third or fourth pivot points (11, 12) of the second bracket means (16). This enables the second bracket means to be vertically swung upward while the first bracket means is attached to the work surface.

In another alternative embodiment, the linkage arms (3, 4) may be fixedly connected to the appropriate brackets by any conventional means, such as a bolt extending through holes in the first and second bracket means and through corresponding openings in the linkage arms. A spacer may be wrapped around said bolt so as to prevent it from sliding out.

The configuration of the first bracket means may vary depending on the specific use to be made of the present invention. In one alternative embodiment, the first bracket means may comprise a top or bottom surface. It may also comprise at least one side wall, a front wall or a rear wall.

The first bracket means also comprises an attaching means (13) for securely and/or removably attaching the first bracket means (16) to the work surface. Preferably, the attaching means (13) is situated away from the area where the linkage arms (3, 4) are attached to the first bracket means (17). In an alternative embodiment, the attaching means (13) may comprise a receptacle (14) for receiving and/or holding a portion of the work surface inserted therein, enabling the first bracket means (17) to be securely attached to the work surface. Preferably, the receptacle (14) is adapted for receiving and securely attaching to an edge of the work surface. The receptacle may be of any rigid material, preferably plastic or metal.

Figure 12:
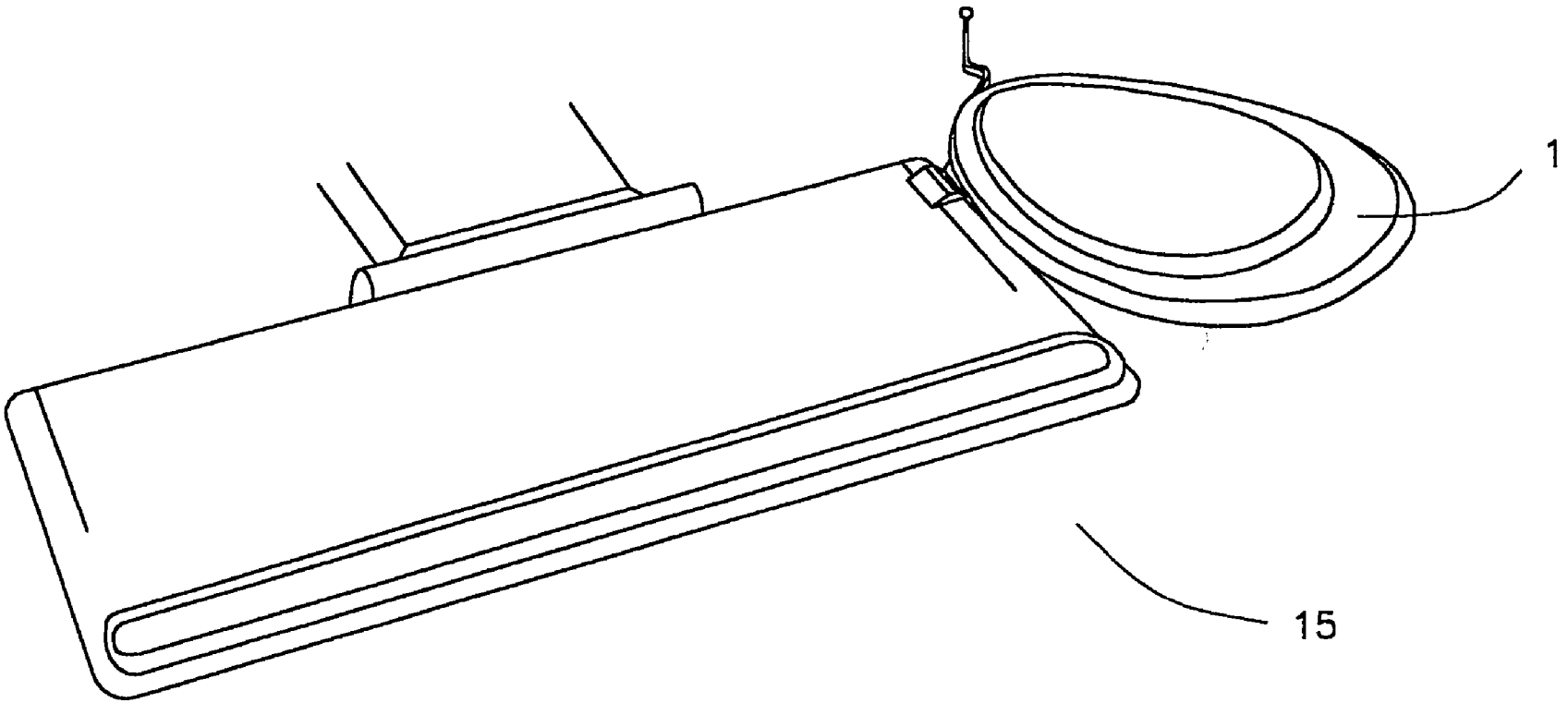
FIG. 12 is a perspective view showing an alternative embodiment of the accessory shelf support mechanism of the present invention; the accessory shelf support mechanism being slidably and removably attached to a keyboard support tray.
Figure 13:
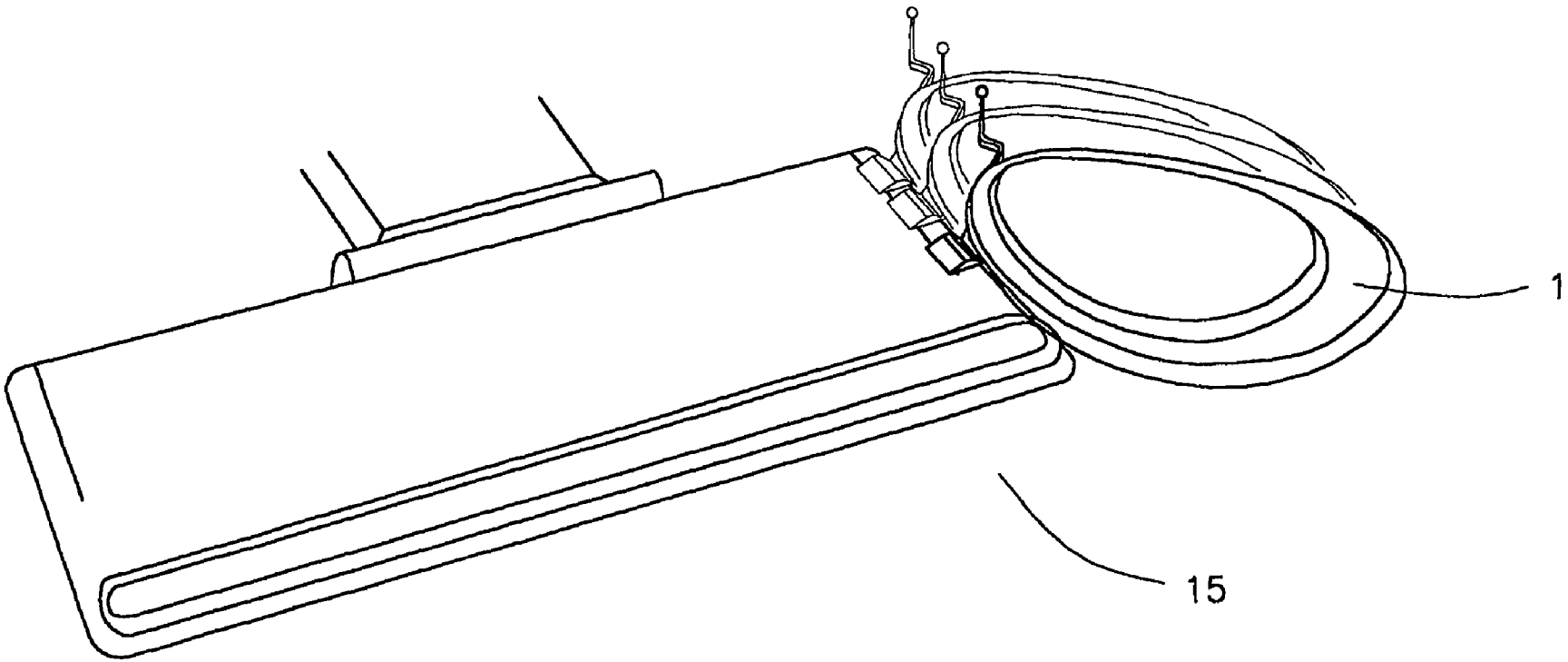
FIG. 13 is the embodiment of FIG. 12 showing the sliding action of the accessory shelf support mechanism of the present invention with a mouse pad positioned on the accessory shelf.
Figure 14:
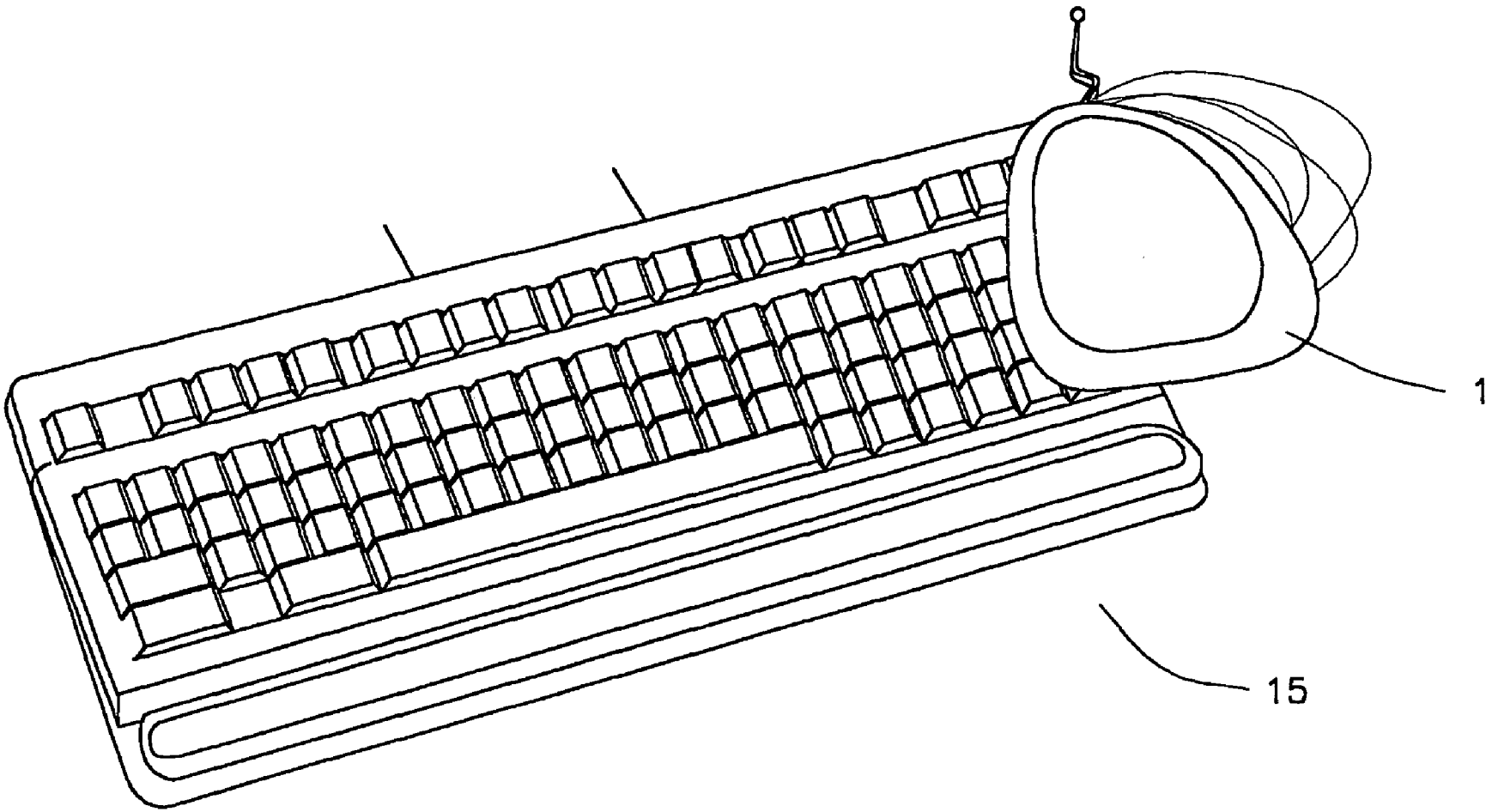
FIG. 14 is the embodiment of FIG. 12 showing the swivel action of the accessory shelf support mechanism of the present invention with a mouse pad positioned on the accessory shelf.
Figure 15:
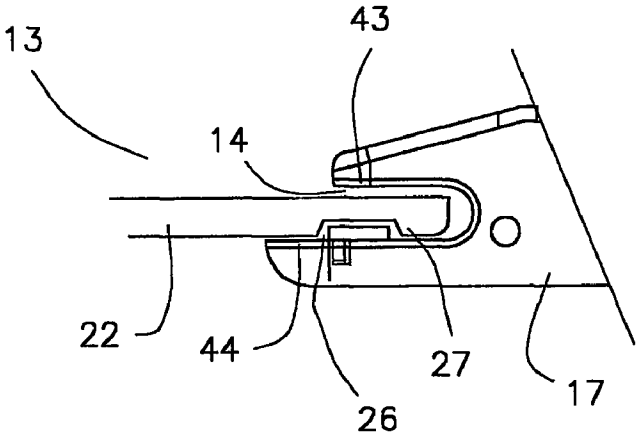
FIG. 15 shows the attaching means of the first bracket means secured to an edge of a work surface.

In one alternative embodiment, the receptacle (14) may comprise a protruding element (26). Alternatively, the receptacle may be adapted for receiving a protruding element associated with the work surface. The protruding element (26) may include, but is not limited to, a ridge, surface, pin, flexible element or any equivalent thereof. The protruding element may be configured for insertion into an aperature or slot positioned in the receptacle or on the work surface, preferably along the edge of the top surface or bottom surface of the work surface. The insertion of the protruding element (26) in an aperture or slot in the top surface or bottom surface of the work surface enables the first bracket means (17) to be maintained in position and/or be slid along the length of the slot or a portion thereof, as shown in FIGS. 12–13. FIG. 15 shows an non-limiting example of the protruding element (26) in a slot on the bottom surface along the edge of the work surface (22).

In another alternative embodiment, the receptacle (14) comprises an upper portion (43) and lower portion (44). The upper and lower portions (43, 44) thereof are interconnected such that the distance between them is at least substantially maintained by a biasing means, including but not limited to a torsion spring. For example, the upper and lower portions (43, 44) may be interconnected by a torsion spring (45) mounted on a pivot pin (46) in any conventional manner. In yet another embodiment, the lower and upper portions (43, 44) are disposed in a clothes-pin type configuration (47) relative to each other. The interconnection of the upper and lower portions (43, 44) through the biasing means enables the receptacle (14) to be readily connected to or removed from the work surface by applying counter pressure to the biasing means. For example, in use, the protruding element (26) in the receptacle (14) maybe disengaged from the slot or aperature in the work surface by applying pressure to either the upper or lower surface (48, 49) of the first bracket means (17). The protruding element (26) is then re-engaged with the slot or aperature upon releasing the pressure from either the upper or lower surface of the receptacle (48, 49). This enables the first bracket means to be readily removed from the work surface and then be readily attached to another area of the same work surface. The engagement of the protruding element into the slot or aperature, coupled with the biasing means, prevents undesired movement of the first bracket means, such as falling off the work surface due to inadvertent contact from the user's hand, for example.

In one alternative embodiment, protruding element (26) may be inserted into a guide slot at the outermost edge of work surface (22). This enables the accessory shelf support mechanism (15) to slide to a desired position along the edge of the keyboard support tray (22). If desired, the accessory shelf support may be released from the keyboard support tray (22) by sliding the first bracket means along the guide slot (27) to the outer edge of the tray (22) where the slot (27) ends. In this manner, the mouse shelf support assembly (15) can be slidingly received into or removed from the guide slot (27). This enables the user to easily move the support assembly from one side of the keyboard support tray (22) to another side having a guide slot capable of receiving protruding element (26).

Figures 9A, 9B, 9C:
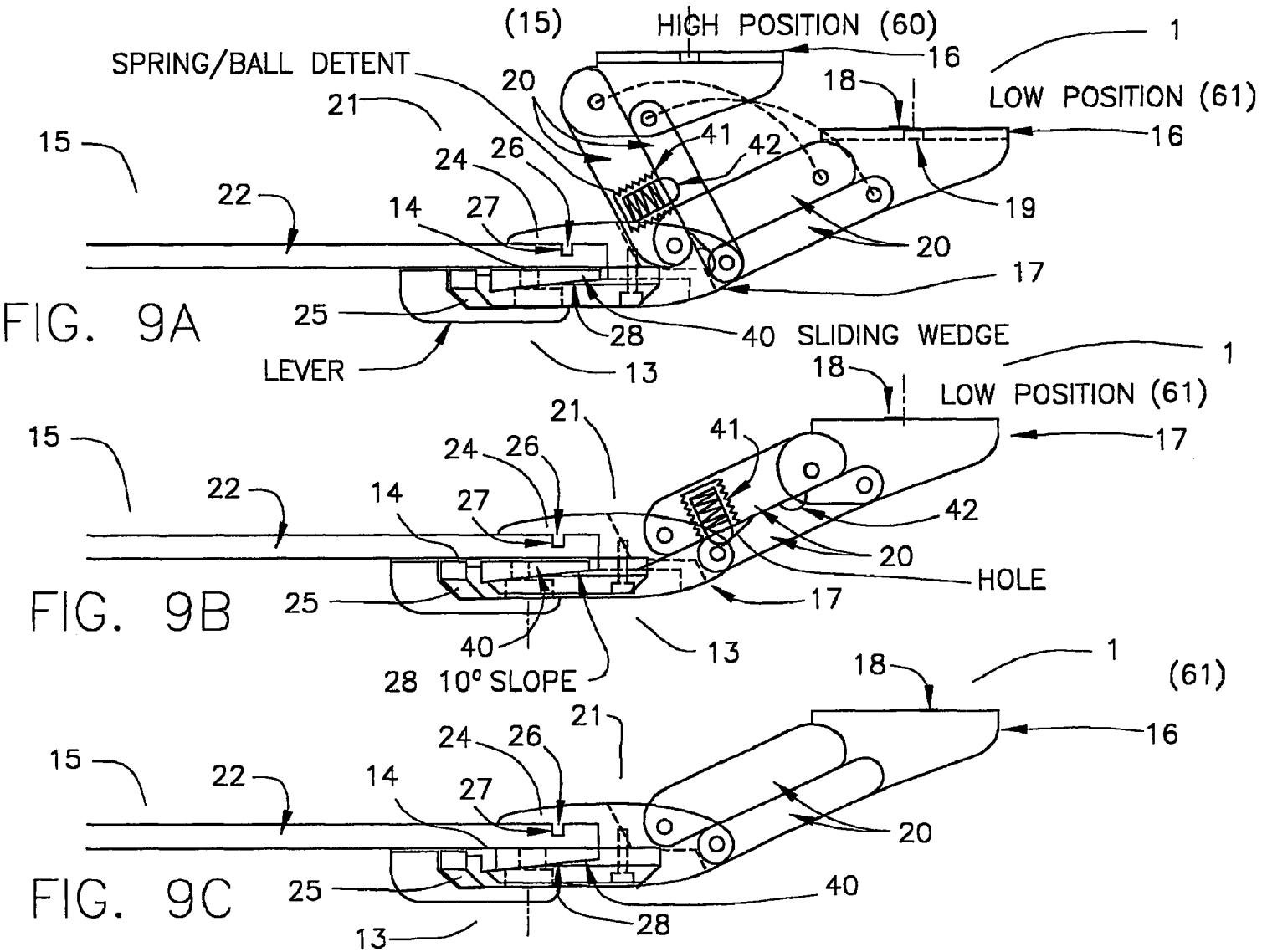
FIGS. 9*a* to 9*c* show several side views of an alternative embodiment of the accessory shelf support mechanism of the present invention; the second bracket means being moved from a high position to a low position, and vice versa, while the first bracket means is attached to an edge of a work surface.
Figure 10:
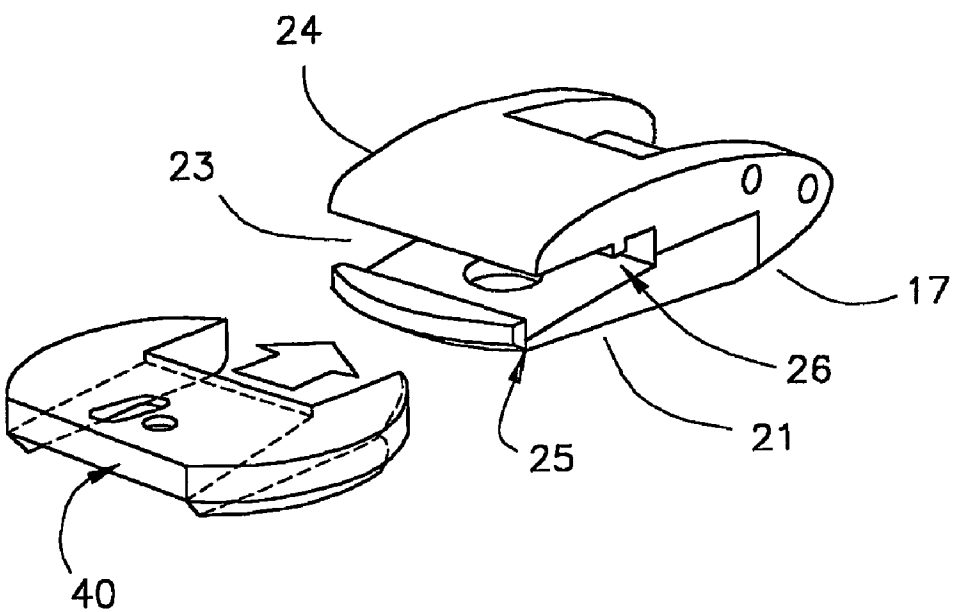
FIG. 10 shows several views of an alternative embodiment of a first bracket means and some of its individual components.
Figure 10:
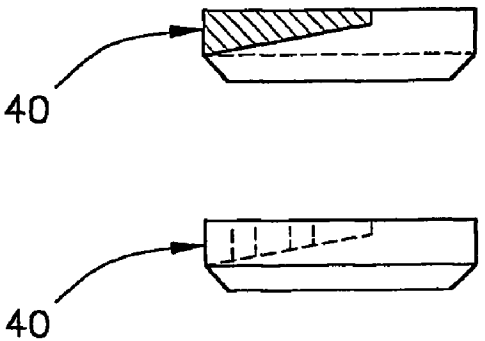
Figure 11:
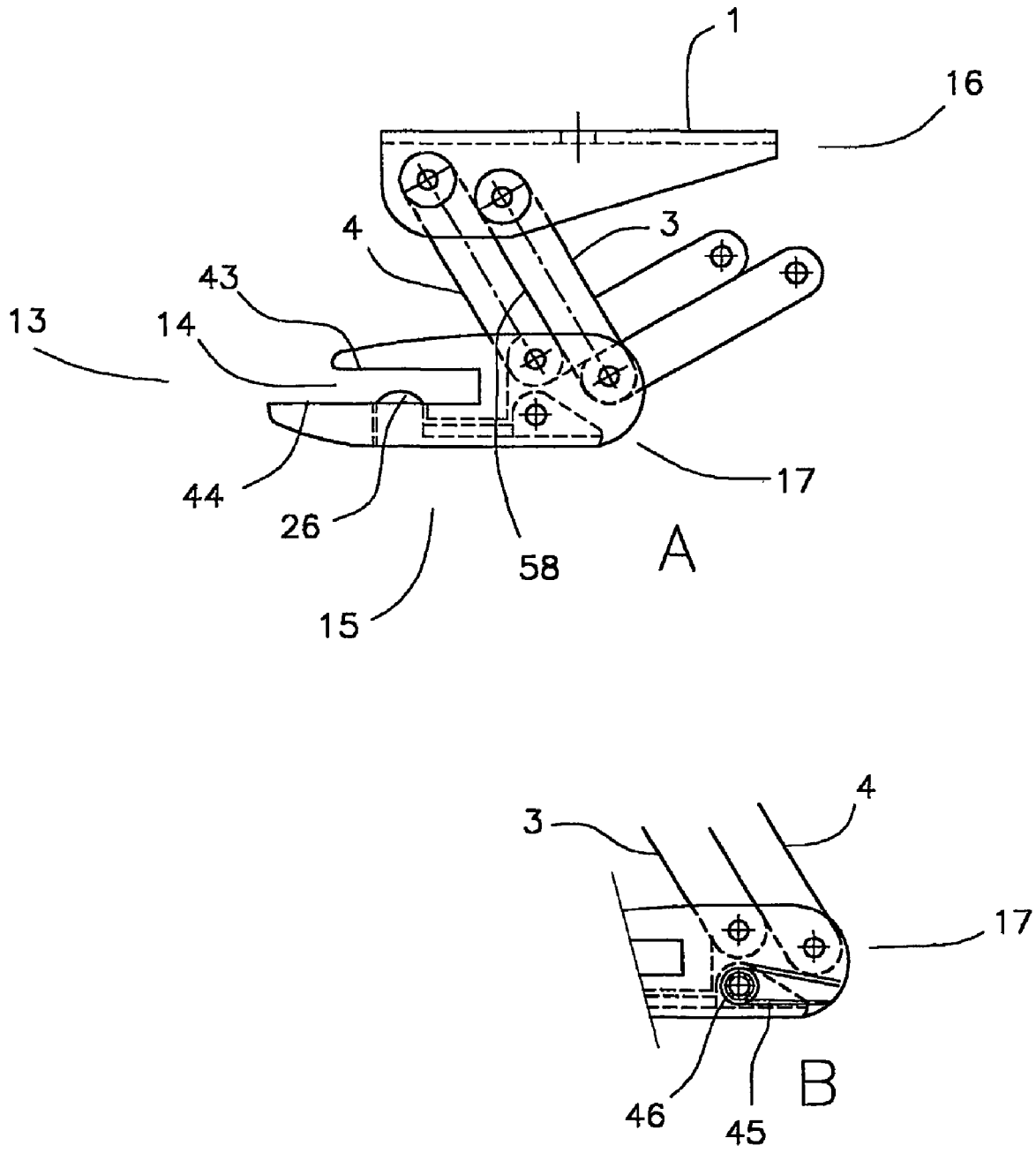
FIGS. 11*a* to 11*b* show views of an alternative embodiment of the accessory shelf support mechanism of the present invention.

FIGS. 9*a* to 9*b* illustrate another non-limiting alternative embodiment of the attaching means (13) of the present invention. Here, receptacle (14) comprises means for driving a wedge shaped member (40) upward to reduce the amount of space between the upper and lower portions (24, 25) of receptacle (14) while the work surface (22) is inserted into the receptacle (14). This mechanism comprises a sloping member (28) within the receptacle (14). The angle of the sloping member (28) may vary, but is preferably about 1–20° off horizontal, and more preferably 10° off horizontal as measured from the opposite side of the receptacle (14).

Alternatively, wedge shape member (40) may be driven upward or downward by various means, including but not limited to a linear action, rotary action, or pressure applied to the upper or lower portions (25) of the receptacle (14) by the user via large thumb tab, or a cam driven mechanism or any other mechanical means known to those skilled in the art.

Figure 8A:
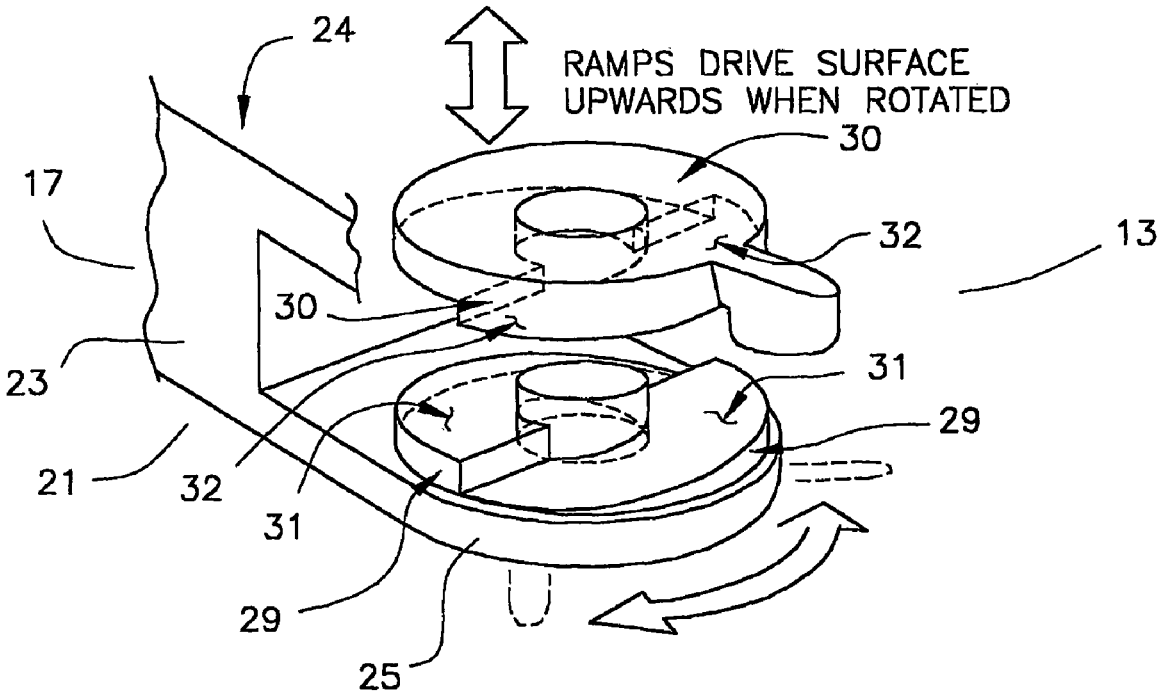
FIGS. 8*a* to 8*b* show a perspective view and side view, respectively, of an alternative embodiment of the accessory shelf support mechanism of the present invention.
Figure 8B:
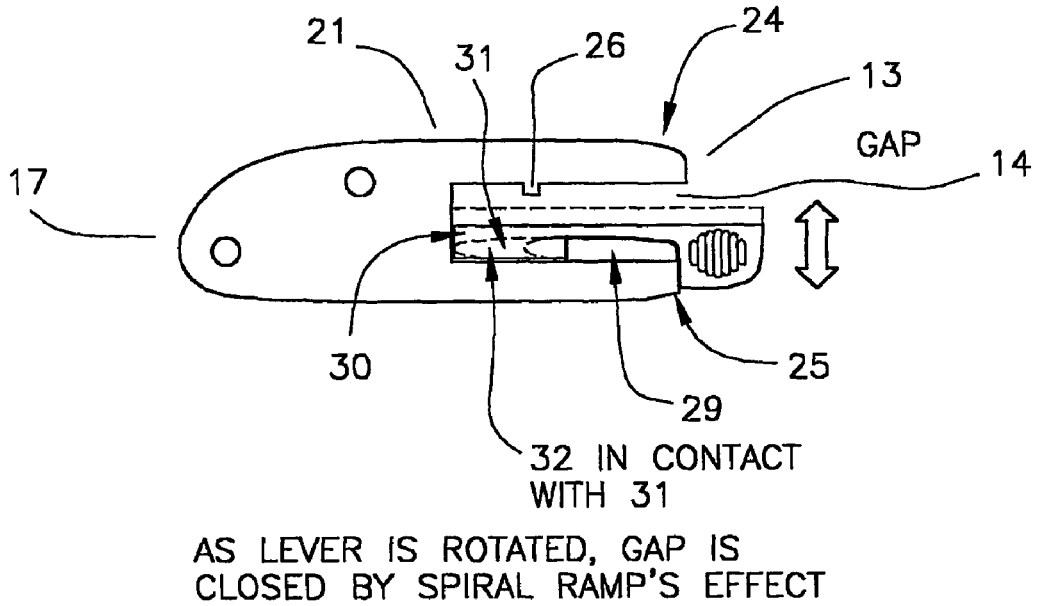

FIG. 8 illustrates another non-limiting alternative embodiment of the attaching means (13) of the present invention. This mechanism includes a first ramp member (29) and a second ramp member (30), each having a top surface and bottom surface. At least a portion of the top surface (31) of the first ramp member (29) gradually inclines in a first direction. At least a portion of the bottom surface (32) of the second ramp member (30) gradually inclines in a second direction, preferably opposite said first direction. The first ramp member (29) is positioned on the lower surface (25) of the receptacle (14). In an alternative embodiment, the second ramp member (30) is positioned on top of the first ramp member (29) so that the top surface of the second ramp member (32) opposes the bottom surface of the first ramp member (31). When the respective inclined surfaces of each ramp member are placed in opposition to each other, the first ramp member is moved upward or downward upon rotating either the first ramp member or second ramp member.

In operation, the first bracket means (17) is removably attached to the work surface by rotating either the first ramp member (29) or second ramp member (30), which in turn cause the first ramp member (29) to move upwardly against the portion of the work surface tray in the receptacle (14). To release the work surface tray from the receptacle (14), either the first or second ramp member (29, 30) is rotated so that either ramp member moves downwardly, thereby enabling the work surface to be removed from the receptacle (14).

The first and second ramp members may comprise any shape so long as they effectuate upward or downward movement of either member when the opposing respective top and bottom surfaces are movably engaged. In an alternative embodiment, the first and second ramp members may be annular and have surface inclines resembling at least a partial spiral on their respective bottom and top surfaces. In an alternative embodiment, the driving action of the first and second ramp member may be manually effectuated by positioning a lever on either the first or second ramp member, and then moving said lever horizontally, preferably in either a clock-wise or counter-clock-wise direction.

In another embodiment, the attaching means (13) of the present invention comprises a receptacle (14) having means for receiving and holding in place the inserted portion of the work surface by friction, by pressure, by gravity, by suitable high friction material within the receptacle or by applying force, or a combination thereof. For example, in one alternative embodiment, the receptacle may comprise friction material, including but not limited to rubber, or the like. Such material being able to grip and hold the work surface within the receptacle. For example, the frictional material may be positioned on the lower portion of the receptacle (14). It is understood that the frictional material may also be positioned on upper portion of the receptacle (14). Other locations for the frictional material include, but are not limited to, the deepest portion of the receptacle (14), or any other suitable contact surface therein. The frictional material (14) prevents undesired movement of the support mechanism when the first bracket means is securely positioned to the work surface.

Swivel Means to Bracket Assembly

The present invention may also comprise a swivel means to permit the accessory shelf to be swiveled into a desired position. In one alternative embodiment, the swivel means may be effectuated by pivotally connecting with the second bracket means (16), shelf bracket (2) and/or the accessory shelf (1) to each other, a pin, threaded stud or screw protruding. The pin, threaded stud or screw may be inserted into a corresponding aperature in either the second bracket means, shelf bracket or accessory shelf facing opposite the pin, threaded stud or screw. Preferably, the point of connection is positioned off-center relative to the second bracket means. This would afford lateral movement as well as pivotal movement of the accessory shelf. If the accessory shelf has the corresponding aperature, a screw and nut may be used to connect the shelf to the shelf bracket or second bracket means.

Tilting Means

The second bracket means (16) may comprise a tilt adjustment means for adjusting the angle of the accessory shelf (1), so as to maintain the shelf in at least a horizontal or level position relative to the user. For example, if the work surface is angled during use, the tilt means of the present invention enables the angle of the mouse shelf to be adjusted so that it is at least substantially horizontal relative to the user while the work surface is angled.

In one alternative embodiment, the tilt adjustment means (50) may comprise a shelf bracket (2) pivotally attached to the second bracket means (16). In another alternative embodiment, the shelf bracket (2) is pivotally attached to a rear wall (51) of the second bracket means (16). The rear wall (51) having a pivot pin (52) and a stud (e.g., threaded stud) (53) extending along a vertical axis. The shelf bracket (2) having an aperture or pivot hole (54) for receiving the pivot pin (52) on the rear wall (51) of the second bracket means (16). The shelf bracket also having a radially shaped elongated slot (55) for receiving the threaded stud (53) of the second bracket means (16). In one alternative embodiment, the length and shape of the elongated slot may be designed to enable the mouse self bracket to be tilted on either side of the slot. The tilt adjustment means (50) may also comprise a torque knob (56) sized to fit over the stud (53) of the second bracket means (16). A washer (57) may be fitted through the threaded stud (53) and positioned between the shelf bracket (2) and the torque knob (56).

To tilt the mouse shelf in a desired position, the torque knob (56) is loosened to allow the shelf bracket (2) to rotate about the pivot pin (52). The shelf bracket (2) is then rotated to a desired angle. The length of the elongated slot (55) limits the movement or rotation of the shelf bracket (2), preferably to a maximum of about 15° on either side. Once the shelf bracket (2) is moved into the desired position, the torque knob (56) is then turned to apply friction between the shelf bracket (2) and the rear wall (51) of the second bracket means (16), thereby securing the accessory shelf (1) into the desired position.

When the first bracket means is attached to the work surface, the second bracket means may be maneuvered upwardly and downwardly several positions including but not limited to a low position and high position. In an alternative embodiment, the second bracket means (16) can be swung upwardly to a high position or swung downwardly to a low position. In the low position, for example, the second bracket means (16) is positioned at about the same level as the first bracket means, preferably about horizontal with the work surface. In the high position, for example, the second bracket means (16) is positioned above the work surface.

To assist the second bracket means in being stationarily maintained at either the low position or high position, the present invention may comprise a first and second stopping means, respectively. One benefit of the first and second stopping means is to restrict the upward and downward movement of the second bracket means, and to maintain the second bracket means (58) in either the low position or high position, respectively. Another benefit of the first and second stopping means is to prevent or restrict accidental displacement of the second bracket means.

With reference to FIG. 1, a non-limiting example of a first stopping means is shown. Here, the first stopping means (58) utilizes the interconnection between the first and second linkage arms (3, 4). Specifically, the second bracket means (16) is maintained in the low position (61) when the two linkage arms (3, 4) come into contact with each other.

The spacing between the linkage arms (3, 4) dictates the extent to which the second bracket means (16) can be lowered relative to the first bracket means (17). The greater the space between the linkage arms, the lower the second bracket can be positioned relative to the first bracket means and vise versa. Preferably, the distance between the linkage arms is such that the second bracket means stops at or about the same level of the first bracket means (17). The second bracket means (16) may also be maintained in the low position (61) by other conventional means known in the art. These include, but are not limited to positioning a platform or extension on the first bracket means (17), such that the second bracket means (16) comes into contact therewith at a point where the second bracket means (16) is about at the same level as the first bracket means (17), for example.

Figure 6:
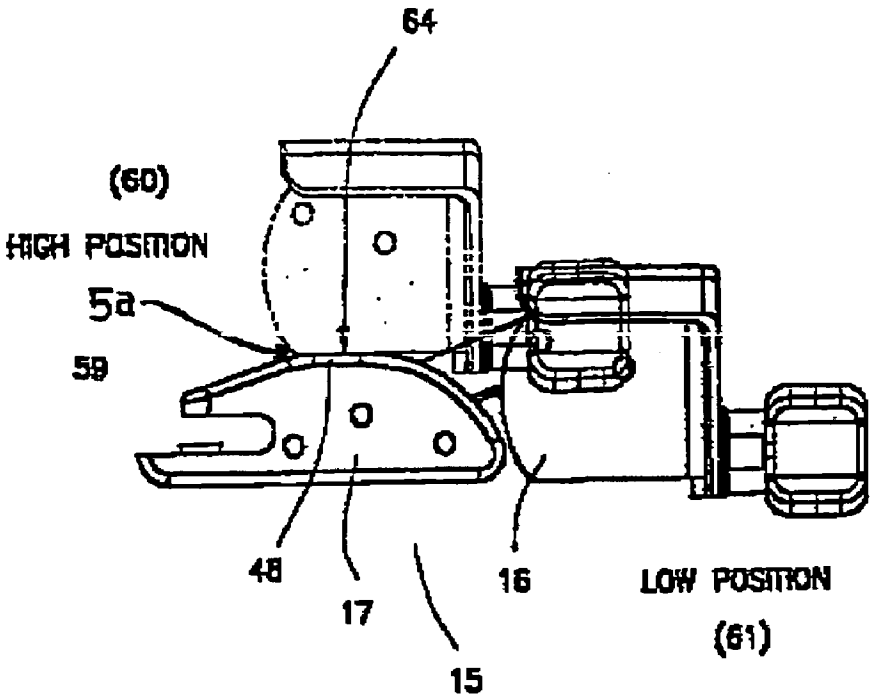
FIG. 6 is the embodiment of FIG. 1 showing the second bracket means of the present invention being moved in a high position and low position.
Figure 7:
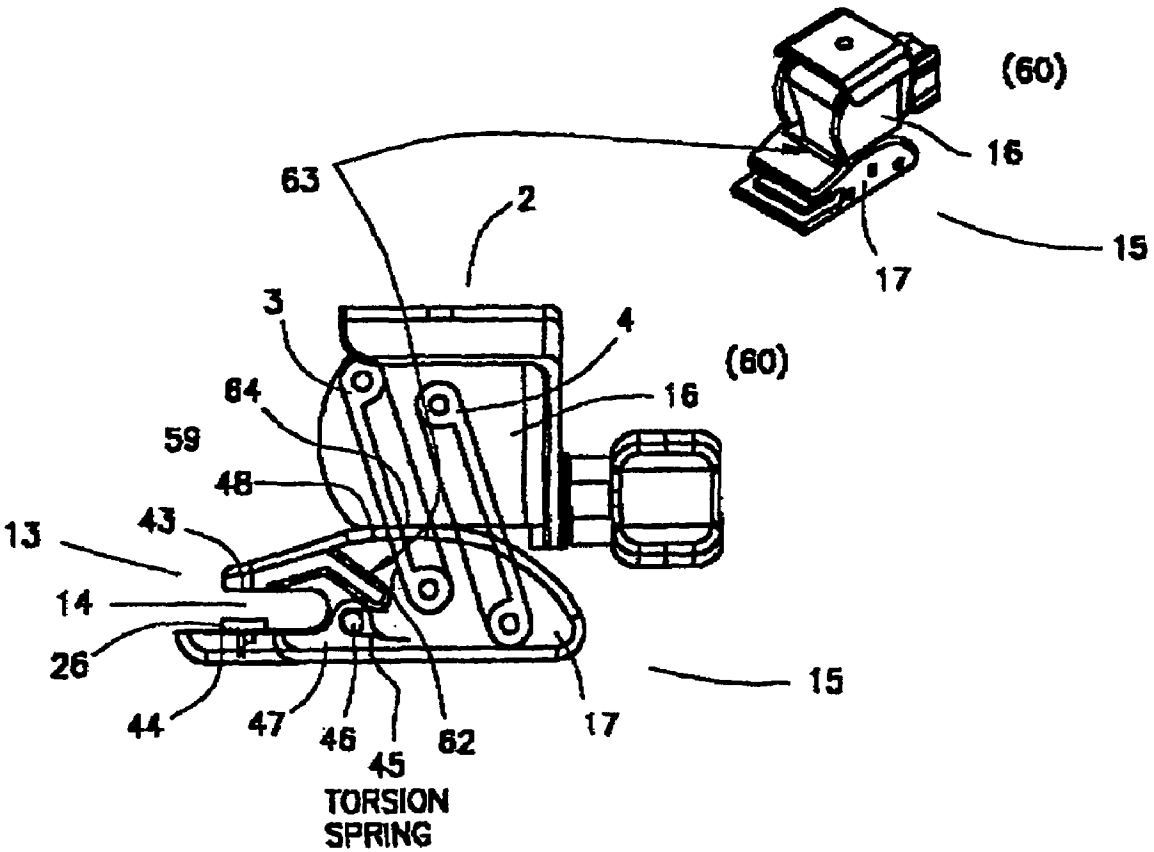
FIG. 7 is the embodiment of FIG. 1 showing the second bracket means of the present invention maintained in a high position.

With reference to FIGS. 6 and 7, a non-limiting example of a second stopping (5*a*) means is shown. In FIGS. 6 and 7, when the linkage arms (3, 4) are swung upwardly, the second bracket means (16) moves upward and radially into the high position (60). As the second bracket means moves upwardly, the lower surface (64) of the second bracket means (16) comes into contact with upper surface (49) of the first bracket means (17), and as a result, movement of the second bracket means (16) is restricted from moving further. The contact between the upper surface (49) of the first bracket means (17) and lower surface (64) of the second bracket means (16) is sufficient to maintain the second bracket means in the high position (60). The contact is also sufficient to prevent or restrict accidental or undesired displacement of the second bracket means while in the high position (60).

In another alternative embodiment, the second stopping means is designed to prevent pinching of the user's fingers while adjusting the second bracket means (16) from the low position (61) to the high position (60). For example, with reference to FIGS. 6 and 7, the first bracket means (16) comprises a stopping surface (62), which is positioned along the travel path of at least one of linkage arms (3, 4) when maneuvered upwardly or downwardly. The stopping surface (62) is positioned such that it comes into contact with at least one linkage arm before the top surface of the first bracket means contacts the bottom surface of the second bracket means during upward movement of the latter. The configuration of the stopping surface may take various forms. For example, it may comprise a "v" shaped recess (63) appropriately positioned along the top surface of the first bracket means (49), as shown in FIGS. 6 and 7. The "v" shape recess forms a gap between the first and second bracket means. The existence of the gap prevents the user from pinching his or her finger while adjusting the second bracket means from the low to high position.

Other stopping means for maintaining the second bracket means in the high or low positions may also include a ratchet and pawl system, a magnetic catch, a hook and loop fastener interface (e.g., velcro) or such other conventional stopping means known to those skilled in the art. The present invention may also comprise an actuated locks or other known mechanism or systems, whereby the user can maintain the linkage arms at any selected elevation between the high and low positions. Such mechanisms or systems may include but are not limited to ratchet and pawl system, a magnetic catch, a hook and loop fasteners interface (e.g., velcro) or such other conventional stopping means known to those skilled in the art.

In an alternative embodiment, influence of gravity may maintain the accessory shelf in the low position. In the high position, the influence of gravity may also maintain the accessory shelf in the high position. In these circumstances, there is no need for employing a specific attaching means to retain a portion of the work surface in the receptacle since the weight of the first and second brackets can bias the receptacle such that the work surface can be held in position. The accessory shelf may further increase the weight on the first bracket means. As a result, the retention of the accessory shelf to the work surface may be further enhanced. In these embodiments, engaging the first bracket means with the work surface by insertion of a protruding element (26) into an aperature or slot would be optional.

With reference to FIGS. 9*a* to 9*b*, another non-limiting embodiment for maintaining the position of the second bracket means is shown. Here, a spring/ball/detent mechanism (41) and mating hole (42) may be employed as a means to engage the two linkage arms together to facilitate stationary placement of the upper bracket in the high position (60). In order to move the upper bracket downwardly (upon application of force), the spring ball detent system (41) disengages from the mating hole (42) through the shearing action of the two linkage arms (20) allowing the mechanism to descend to a lower position (61).

The figures and attachments herein are presented for illustrative purposes only. They are not intended to limit the scope of the invention. Further, it should be understood that various changes and modifications to the embodiments described herein will be apparent to those skilled in the art. Such changes and modifications can be made without departing from the spirit and scope of the present invention and without diminishing its intended advantages. It is therefore intended that such changes and modifications be covered by the appended claims.

Also, the invention may suitably comprise, consist or consist essentially of any of the individual components described herein. Further, the invention described herein suitably may be practiced in the absence of any component which is not specifically disclosed herein.

We claim:

1. A multipositional accessory support shelf mechanism for conveniently placing one or more handheld items thereon while operating a computer keyboard, comprising:

(i) a first bracket means; the first bracket means having an attaching means for securely positioning the first bracket means to a work surface;

(ii) a second bracket means having an accessory shelf connected thereto;

(iii) a pair of linkage arms; one end of each arm is connected to the first bracket means at a spaced interval; and the other end of each linkage arm is connected to the second bracket means at a spaced interval; and (iv) the attaching means is configured and disposed on the first bracket means to permit ready movement of the first bracket means from a first area of the work surface to a second area of the work surface.

2. The support mechanism of claim 1, wherein the work surface is a keyboard support tray.

3. The support mechanism of claim 1, wherein the work surface is a desk, table, or shelf.

4. The support mechanism of claim 1, wherein the work surface is a computer.

5. The support mechanism of claim 1, wherein the attaching means of the first bracket means is capable of permitting removal of the first bracket means from the first area of the work surface and ready attachment of the first bracket means to the second area of the work surface.

6. The support mechanism of claim 1, wherein the attaching means of the first bracket is capable of permitting the first means to slide from the first area of the work surface to the second area of the work surface.

7. The support mechanism of claim 6, wherein the first area and second area of the work surface are both situated along the same edge of the work surface.

8. The support mechanism of claim 1, wherein the first area and the second area of the work surface are both situated along opposite edges of the work surface.

9. The support mechanism of claim 1, wherein the accessory shelf is suitable for receiving a computer accessory item thereon.

10. The support mechanism of claim 9, wherein the accessory shelf is suitable for receiving a computer mouse thereon.

11. The support mechanism of claim 9, wherein the accessory shelf is suitable for receiving a computer mouse pad thereon.

12. The support mechanism of claim 9, wherein the accessory shelf is suitable for receiving a palm pilot thereon.

13. The support mechanism of claim 9, wherein the accessory shelf is suitable for receiving a mini-video camera thereon.

14. The support mechanism of claim 1, wherein the linkage arms are stationarily connected to the first bracket means and second bracket means, respectively.

15. The support mechanism of claim 1, wherein each end of each linkage arm is pivotally connected to the first bracket means and second bracket means, respectively, thus permitting movement of the accessory shelf while the first bracket means is securely positioned to the work surface.

16. The support mechanism of claim 1, wherein each end of each linkage arm is pivotally connected to the first bracket means and the second bracket means, respectively, thus providing means for moving the second bracket means from a first area to a second area while the first bracket means is securely positioned to the work surface.

17. The support mechanism of claim 1, wherein the connection of the linkage arms to the first bracket means and second bracket means is a parallel linkage.

18. The support mechanism of claim 1, wherein the connection of the linkage arm to the first bracket means and second bracket means is a non-parallel linkage.

19. The support mechanism of claim 1, wherein the second bracket means comprises a shelf bracket on which an accessory shelf is securely positioned.

20. The support mechanism of claim 19, wherein the shelf bracket has a surface having at least one aperture for receiving a pin on the accessory shelf, thereby providing a connecting point between the second bracket means and the accessory shelf.

21. The support mechanism of claim 19, wherein the surface of the shelf bracket has at least one pin for inserting into an aperture on the accessory shelf, thereby providing a connecting point between the second bracket means and the accessory shelf.

22. The support mechanism of claim 19, wherein the shelf bracket is connected to the second bracket means by utilizing one or more bolts, clamps, hooks, latches, locks, pins, rivets, screws, or any combination thereof.

23. The support mechanism of claim 19, wherein the shelf bracket is fastened to the second bracket means by spot-welding, flat riveting, or any combination thereof.

24. The support mechanism of claim 19, wherein the shelf bracket is pivotally connected to the second bracket means, thus permitting movement of the shelf bracket.

25. The support mechanism of claim 1, wherein at least a portion of the shelf bracket is positioned on a top surface of the second bracket means.

26. The support mechanism of claim 1, wherein the attaching means comprises a receptacle for receiving an area of the work surface, enabling the first bracket means to be securely positioned to the work surface.

27. The support mechanism of claim 26, wherein the receptacle of the attaching means comprises an upper portion and a lower portion; the upper portion or lower portion of the receptacle having a protruding element for insertion into an aperture or guide slot on the work surface; wherein the insertion of the protruding element into the aperture or guide slot enables the first bracket means to be securely positioned to the work surface.

28. The support mechanism of claim 26, wherein the guide slot is configured so that the protruding element, when inserted therein, enables the first bracket means to be slid along the work surface or portion thereof.

29. The support mechanism of claim 26, wherein the attaching means is positioned at an end opposite where the linkage arms are attached to the first bracket means.

30. The support mechanism of claim 26, wherein the receptacle comprises an upper portion and a lower portion that are interconnected; the distance between the upper and lower portions is at least substantially maintained by a biasing means; and the interconnection of the upper and lower portions through the biasing means enables the receptacle to be readily removed from or secured to the work surface by applying and releasing counter pressure to the biasing means, respectively.

31. The support mechanism of claim 30, wherein the biasing means comprises a torsion spring mounted on a pivot pin such that the lower and upper portions of the receptacle are disposed in a clothes-pin type configuration relative to each other.

32. The support mechanism of claim 1, wherein the attaching means comprises a receptacle comprising an upper portion and a lower portion; a clamping element is positioned within the receptacle; the clamping element being movably engaged with the lower portion and upper portion of the receptacle, whereby the receptacle is securely positioned onto the working surface by moving the clamping element in a direction that causes the upper portion and lower portion of the receptacle to contact the work surface.

33. The support mechanism of claim 32, wherein the clamping element has a sloped surface.

34. The support mechanism of claim 32, wherein the angle of the slope of the clamping element is about 1–20°.

35. The support mechanism of claim 32, wherein the angle of the slope of the clamping element is about 1–10°.

36. The support mechanism of claim 32, wherein the upper portion and lower portion of the receptacle come into contact with the work surface by moving the clamping element in a linear direction.

37. The support mechanism of claim 1, wherein the receptacle comprises a first ramp member and a second ramp member; each ramp member having a top surface and a bottom surface; at least a portion of the top surface of the first ramp member gradually inclines in a first direction; at least a portion of the bottom surface of the second ramp member gradually inclines in a second direction, opposite the first direction;

(i) the first ramp member is positioned on either the lower surface or the upper surface of the receptacle; the second member is positioned on the other of said surfaces; the second ramp member is positioned on top of the first ramp member so that the respective inclined surfaces of each ramp member are placed in opposition of each other; either ramp member is moved upward or downward upon rotating either the first ramp member or second ramp member;

(ii) the first bracket means is securely positioned to the work surface by rotating either the first ramp member or second ramp member in a first direction, which in turn causes either ramp member to move against the portion of the work surface in the receptacle; and (iii) the first bracket means is removed from the work surface by rotating either the first ramp member or second ramp member in a direction opposite the first direction, which in turn cause either ramp member to move away from the portion of the work surface in the receptacle.

38. The support mechanism of claim 37, wherein the first and second ramp member are annular and have surface inclines resembling at least a partial spiral on their respective bottom and top surfaces.

39. The support mechanism of claim 37, wherein a lever is positioned on either the first ramp member or second ramp member; the first ramp member and second ramp member are annularly rotated in opposite directions by moving the lever horizontally.

40. The support mechanism of claim 26, wherein the receptacle has means for receiving and securely holding in place the inserted portion of the work surface by friction, by pressure, by gravity, by suitable friction material, by applying a force or a combination thereof.

41. The support mechanism of claim 1, wherein the mechanism further comprises a swivel means for permitting the accessory shelf to be swiveled into a desired position.

42. The support mechanism of claim 41, wherein the swivel means comprises a shelf bracket pivotally connected to the second bracket means; the accessory shelf being connected to the shelf bracket; wherein the point of connection between the shelf bracket and second bracket means is off-center relative to a top surface of the second bracket means.

43. The support mechanism of claim 41, wherein the swivel means comprises a pivotal connection between the second bracket means and the accessory shelf, wherein the point of connection between the accessory shelf and the second bracket means is off-center to the top surface of the second bracket means.

44. The support mechanism of claim 1, wherein the second bracket means further comprises a tilt means for permitting the accessory shelf to be tilted into a desired position.

45. The support mechanism of claim 44, wherein the tilt means comprises a shelf bracket pivotally attached to a rear wall of the second bracket means:

(i) the rear wall having a pivot pin and a stud extending along a vertical axis;

(ii) the shelf bracket having a pivot hole for receiving the pivot pin on the rear wall of the second bracket means;

(iii) the shelf bracket having an aperture for receiving the stud therethrough;

(iv) the tilt means further comprising a torque knob sized to fit over the stud of the bracket means;

(v) the torque knob is configured and disposed so that when turned in a first direction the shelf bracket is able to rotate about the pivot pin on the rear wall of the second bracket means into a desired position; the shelf bracket is maintained in the desired position by applying friction between the shelf bracket and the rear wall of the second bracket means; said friction being applied by turning the torque knob in a second direction, opposite the first direction.

46. The support mechanism of claim 1, further comprising a first and second stopping means for maintaining the second bracket means in a first position and a second position, respectively; the first position being above the work surface and the second position being at least substantially horizontal to the work surface.

47. The support mechanism of claim 46, wherein the first stopping means comprises the interconnection between the first and second linkage arms, wherein the second bracket means is maintained in the first position when the proximity between the first and second linkage arms is such that said linkage arms are restricted from further downward movement.

48. The support mechanism of claim 46, wherein the second stopping means comprises interaction between a top surface of the first bracket means and a bottom surface of the second bracket means; wherein the second bracket means is maintained in the second position when the proximity between the said top surface and bottom surface is such that the second bracket means is restricted from moving further when the second bracket means is moved upward.

49. The support mechanism of claim 1, further comprising a retention means for stationarily maintaining the second bracket means when moved in a upward position.

50. The support mechanism of claim 49, wherein the retention means comprises a spring loaded ball and detent positioned inside one of the linkage arms.

51. The support mechanism of claim 49, wherein the retention means comprises a ratchet and pawl.

* * * * *